United States Patent [19]

Medicus

[11] 3,976,253

[45] Aug. 24, 1976

[54] EXCENTER MILL

[76] Inventor: Gustav K. Medicus, 7521 W. Hyland Drive, Dayton, Ohio 45424

[22] Filed: May 12, 1975

[21] Appl. No.: 576,506

[52] U.S. Cl. ..... 241/167; 241/248; 241/252; 241/253

[51] Int. Cl.[2] ..... B02C 23/00

[58] Field of Search ..... 241/167, 244, 245, 248, 241/252, 253, 254, 257 R, 258

[56] References Cited

UNITED STATES PATENTS

| | | | |
|---|---|---|---|
| 511,864 | 1/1894 | Seymour | 241/245 |
| 1,538,791 | 5/1925 | Fowler | 241/252 |
| 2,172,704 | 9/1939 | Gentilli | 241/252 |
| 2,246,846 | 6/1941 | Hennessy | 241/252 |

FOREIGN PATENTS OR APPLICATIONS

| | | | |
|---|---|---|---|
| 392 | 1/1878 | United Kingdom | 241/252 |

*Primary Examiner*—Roy Lake
*Assistant Examiner*—Neil Abrams
*Attorney, Agent, or Firm*—Joseph E. Rusz; Richard J. Killoren

[57] ABSTRACT

A milling apparatus having a milling disc which is rotated about its axis by a motor and a tubular milling member having one end supported in contact with the milling disc with the axis of the tubular milling member being eccentric with respect to the axis of the milling disc and held in place by a support arm. Milling good is supplied to the tubular member by means of a funnel member supported in the tubular member. A variable spring system permits the adjustment of pressure between the tubular member and the disc. The milled material is removed from the milling disc by means of a scraper or by centrifugal force.

2 Claims, 6 Drawing Figures

Fig-1
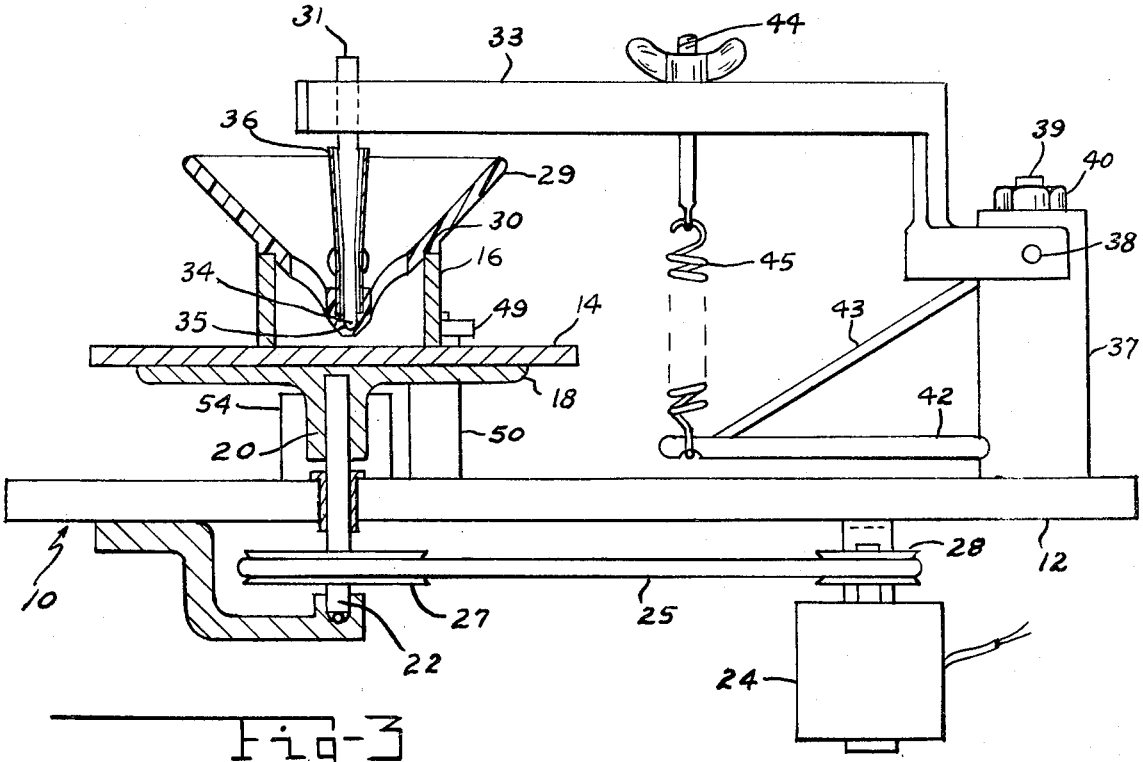
Fig-3
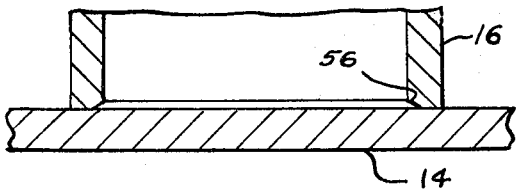
Fig-4
Fig-5
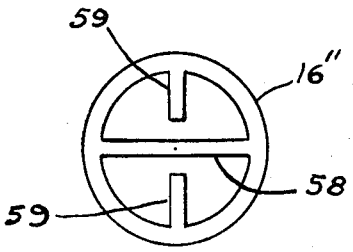
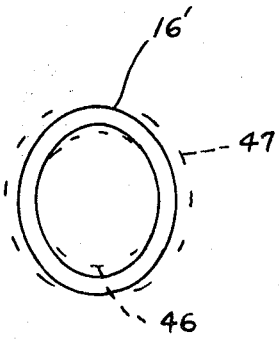

49
50
54
56
48
51
14
33
42
38
37
39
44
38
16
29
12

31
33
44
39
40
29'
16'''
60
45
38
14
43
37
42
18
12
22
25

EXCENTER MILL

RIGHTS OF THE GOVERNMENT

The invention described herein may be manufactured and used by or for the Government of the United States for all governmental purposes without the payment of any royalty.

BACKGROUND OF THE INVENTION

This invention relates to milling devices used for reducing the size of particles of milling good and for uniformly mixing two or more components of milling good.

Two types of prior art milling devices used for producing and mixing fine grained material are the ball mill and the colloid mill.

One problem with the ball mill is the unmilled particles that are trapped in the brim of the lid and the accumulation of unmilled particles, on the vertical wall of the barrel, which results in an extended tail of the distribution function of the grain size toward increasing grain size. The ball mill also has a comparatively large amount of milled products which adhere to the balls, to the barrel and to the lid. This is undesirable when milling small amounts of milling good and makes the cleaning of the mill more difficult. In the ball mill, it is practically impossible to dry-mill sticky powders.

Dry-milling with the colloid mill is not possible. Also, a large amount of high precision work is needed in making a colloid mill and thermal expansion is a problem which makes the apparatus very costly to produce.

There is no known apparatus which will provide screening action for very fine particle sizes.

BRIEF SUMMARY OF THE INVENTION

According to this invention, a new type of mill is provided for reducing the size of milling good, for uniformly mixing two or more components of milling good and for screening material according to particle size.

The milling device of this invention has two main parts, a grinding disc and a tubular grinding member which has one end held against the grinding disc and which has its axis displaced from the axis of the grinding disc.

The disc is rotated about its axis by some drive means, such as a motor and drive belt. The tubular member is rotated by the difference in velocities of the disc along the circumference of the tubular member. A funnel member, for supplying milling good to the tubular member, is held in position by a shaft connected to a support arm and in turn positions the tubular member on the grinding disc.

A spring connected to the support arm is used to adjust the pressure between the tubular member and grinding disc. The milled material is removed from the grinding disc by means of a scraper or by means of centrifugal force.

IN THE DRAWINGS

FIG. 1 is a view partially in section of a milling device according to the invention.

FIG. 3 is an enlarged sectional view of the milling disc and modified tubular member for use with the device of FIG. 1.

FIG. 4 is another modified tubular member which may be used with the device of FIG. 1.

FIG. 5 shows a further modification of a tubular member for use with the device of FIG. 1.

DETAILED DESCRIPTION OF THE INVENTION

Figure 2:
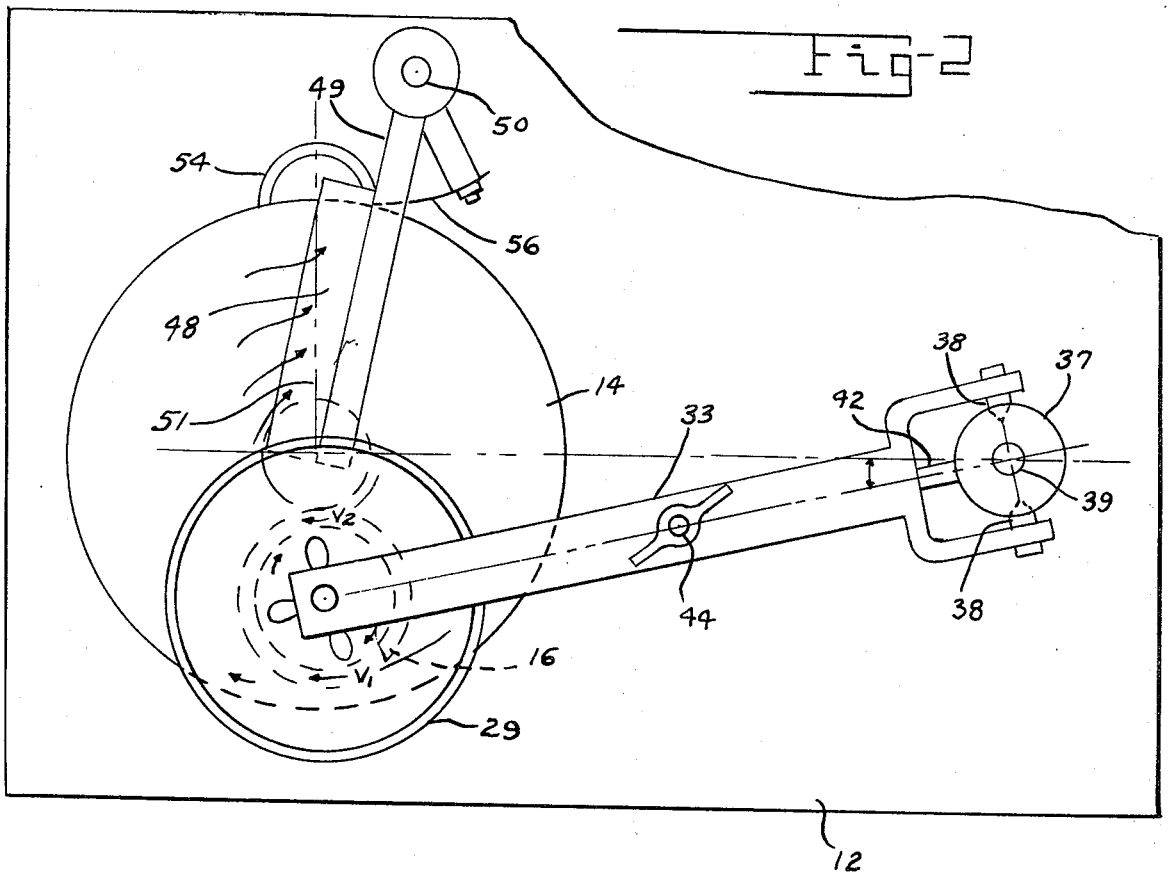
FIG. 2 is a partially cut away top view of the device of FIG. 1.

Reference is now made to FIG. 1 of the drawing which shows a milling apparatus 10 having a support plate 12 and first and second grinding and crushing members 14 and 16 commonly called mill stones. The mill stone 14 is a disc member supported on a support disc 18. The support disc has a sleeve member 20 which is secured to a shaft 22. The shaft 22 may be driven in any conventional manner. For example, the shaft may be driven by a motor, such as shown at 24, and a belt 25 with pulleys 27 and 28. In the device constructed, the shaft was driven with a gear system.

The mill stone 16 is a tubular member having a diameter smaller than the diameter of the disc 14 and having one end in contact with the disc member 14.

A filling funnel 29 is positioned within the tubular member 16 and has a step portion 30 engaging the member 16. A positioning shaft 31 held by positioning arm 33 has a ball shaped end 34 which is positioned within a ball socket 35 in the funnel 29. The distance between the ball end 34 and the surface of disc 14 is much less than the diameter of tubular member 16 to avoid tilting of the tubular member. A sleeve member 36 surrounds the shaft 31 and is secured to the funnel 29. The sleeve 36 keeps the milling good from entering the socket 35.

The positioning arm 33 is pivoted upon a support post 37 with the pivots 38 being approximately in alignment with the top of the tubular member 16. This permits the funnel to be removed from the tubular member without changing the position of the tubular member 16.

The post 37 is angularly movable on shaft 39 to permit the positioning of the tubular member 16 on the disc 14. The member 16 is located on disc 14 so that its axis is displaced from the axis of rotation of disc 14. The tubular member 16 is then rotated by the difference in velocities $V_1$ and $V_2$ of the disc along the circumference of the tubular member. The arm 33 is locked in position by means of a nut 40.

A beam 42 is secured to post 37 and has a brace 43 secured between post 37 and a region near the outer end of the beam. A spring 45 is connected between the beam 42 and an adjusting member 44 on arm 33. Adjustment of member 44 changes the pressure between the tubular member 16 and the disc 14.

To remove the milled material from the disc member 14, a scraper 48 supported in a scraper holder 49 is positioned adjacent the top of disc 14. The holder is supported on post 50 with the edge of scraper 48 inclined with respect to the radius of disc 14, indicated at 51, so that the milled material will move toward the outer edge of the disc. The milled material can be collected in a container 54. An edge scraper 56 may also be provided when needed.

To provide various mixing and milling functions, it is possible to adjust the pressure between the tubular member and the grinding disc, the speed of rotation of the grinding disc, the position of the tubular member on the grinding disc, the shape of the tubular member, the shape of the inner edge of the tubular member, the characteristics of the milling surfaces and the use of different suspending fluids or the use of a dry milling good. Various materials may be used for the milling surfaces, for example, the disc 14 and tubular member 16 may be made of sintered alumina. There are an infinite number of combinations of surface properties which may be chosen for producing different type of milling operations. Valleys in different directions may be provided in the milling surfaces for coarser grinds and mesa-type surfaces may be provided for finer grinding operations.

The mill of this invention produces a milled material with a sharp cut-off at a maximum grain size which permits the use of the mill as a sieve. The screening action of the mill is most pronounced when the inner edge of the tubular member 16 is sharp. The size of the particles that enter the grinding area is limited by the gap between the mill stones. This gap is determined mainly by the viscosity of the suspended fluid, the force exerted by the spring 33 and the speed of rotation of disc 14. The particles which are larger than the gap are screened out and accumulated inside the tubular member 16. If it is desired that larger particles are included in the milling process, the inner zone of the tubular member may be beveled as shown at 56 in FIG. 3. Also, other shapes, than that shown, can be used for the tubular member 16 such as the elliptical shape as shown in FIG. 4 where the tubular member wipes an area shown between circles 46 and 47. Other shapes, not shown, could also be used for certain applications. For some applications, it may be desirable to have internal members, such as shown at 58 and 59 in FIG. 5, to increase the contact area between tubular member 16'' and the disc member 14. These will also act to agitate the milling good within the tubular member 16''.

In the operation of the disc of the invention, the arm 33 is set to position the tubular member 16 on the disc 14. Milling good is then supplied to the tubular member 16 through funnel 29. The motor 24 is then started to rotate disc 14. The difference in velocity of the disc 14 along the circumference of the tubular member 16 causes rotation of the tubular member 16. The milled material is removed from the disc 14 by means of scraper 48 and is collected in container 54. The milled material may be returned to the cylinder 16 if additional milling is desired to produce a finer grind or for additional mixing.

Figure 6:
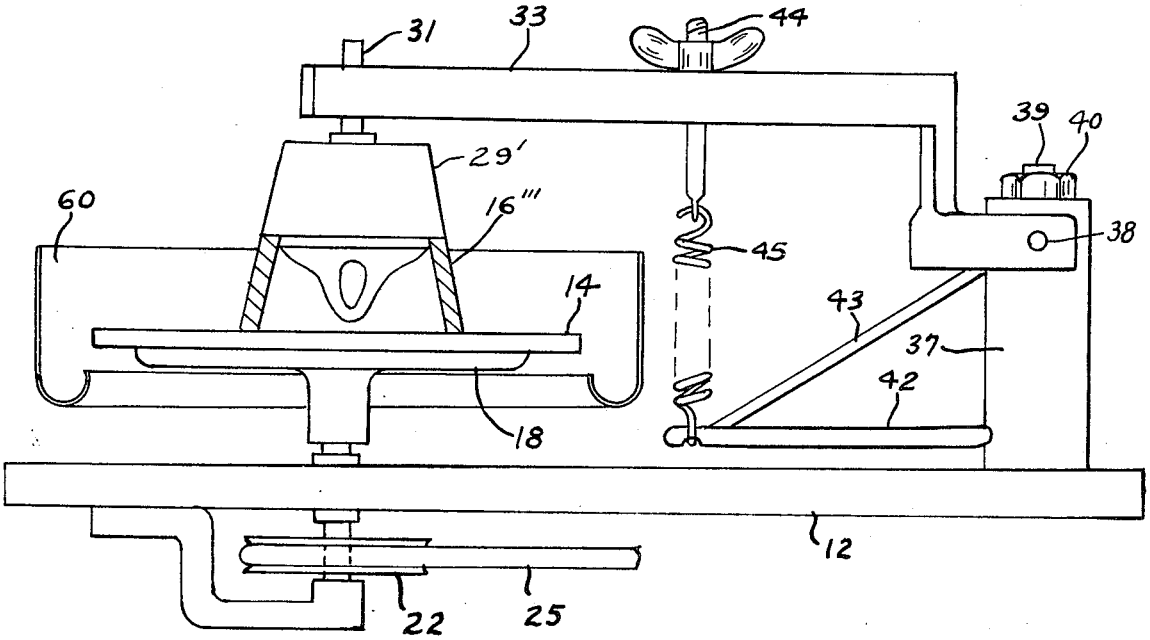
FIG. 6 is a side elevation partially in section of another embodiment of the invention.

The material may be moved to container 54 by gravity by tilting the milling apparatus or by means of centrifugal force, as shown in FIG. 6. In this apparatus a catcher 60 is positioned around the disc 14. With higher disc velocities, it may be desirable to use a frustoconical shape for the tubular-member 16''' to aid in moving the material toward the milling surfaces. The top of funnel 29' should also be turned inward at higher disc velocities. Also, the tubular member would normally be moved nearer to the axis of the disc member to reduce its rotational velocity.

Though not shown, it may be desirable for some applications to provide a cover member for the milling apparatus. When a cover is used, the milling good can be supplied to funnel 29 through another funnel passing through the cover member. The funnel 29 may be made of various materials. In the device constructed, funnel 29 was made of a plastic material.

Though the milling member 14 has been described as flat, it is to be understood that this member could also be made with a concave or convex spherical shaped milling surface.

There is thus provided an improved milling apparatus for producing fine grain material, for mixing milling material and for screening materials according to size.

I claim:

1. A milling apparatus, comprising: a first milling member forming one mill stone for said milling apparatus; a tubular member forming a second mill stone for said milling apparatus; said tubular milling member having a sutatantially planar end in contact with said first milling member; the surface area of said first milling member being substantially greater than the total end area of said tubular member; means for rotating the flat milling member around its central axis, means for positioning the tubular member on the flat milling member with the central axis of the tubular member displaced from the central axis of the flat milling member; means for supplying milling good to said tubular member; a container positioned adjacent the edge of said disc member; means for scraping milled material from said flat milling member into said container; said means for supplying milling good to said tubular member including a funnel shaped member fitting into the top of said tubular member; said means for positioning the tubular member on the substantially flat milling member including a pivotable arm member; means for supporting said arm member adjacent said flat milling member; a shaft supported on said arm; said shaft having a ball shaped end portion; said funnel shaped member including a ball socket for engaging the ball shaped end portion of said shaft; means within said funnel member for keeping milling good from entering said ball socket.

2. The device as recited in claim 1 wherein said pivotable arm member includes means for adjusting the pressure between said tubular milling member and said substantially flat milling member.

* * * * *